US007000769B2

(12) United States Patent
Killinger

(10) Patent No.: US 7,000,769 B2
(45) Date of Patent: Feb. 21, 2006

(54) CHILD RESISTANT BLISTER PACKAGES UTILIZING WALLED STRUCTURES ENCLOSING MEDICAMENT THEREIN

(75) Inventor: Fred Mieras Killinger, Durham, NC (US)

(73) Assignee: Smithkline Beecham Corporation, Philadelphia, PA (US)

( * ) Notice: Subject to any disclaimer, the term of this patent is extended or adjusted under 35 U.S.C. 154(b) by 0 days.

(21) Appl. No.: 10/506,879

(22) PCT Filed: May 20, 2004

(86) PCT No.: PCT/US2004/016124

§ 371 (c)(1),
(2), (4) Date: Sep. 3, 2004

(87) PCT Pub. No.: WO2004/103255

PCT Pub. Date: Dec. 2, 2004

(65) Prior Publication Data

US 2005/0087474 A1 Apr. 28, 2005

Related U.S. Application Data

(60) Provisional application No. 60/472,064, filed on May 20, 2003.

(51) Int. Cl.
*B65D 83/04* (2006.01)

(52) U.S. Cl. ..... 206/534; 206/538; 206/461; 206/828

(58) Field of Classification Search ..... 206/461–471, 206/531, 532, 534, 538, 539, 828
See application file for complete search history.

(56) References Cited

U.S. PATENT DOCUMENTS

| | | | | |
|---|---|---|---|---|
| 3,129,817 | A * | 4/1964 | Rohdin | 206/462 |
| 3,809,220 | A | 5/1974 | Arcudi | |
| 3,809,221 | A | 5/1974 | Compere | |
| 3,811,564 | A | 5/1974 | Braber | |
| 3,835,995 | A | 9/1974 | Haines | |
| 3,872,970 | A | 3/1975 | Edison | |
| 3,899,080 | A | 8/1975 | Brunda | |
| 3,905,479 | A | 9/1975 | Gerner et al. | |
| 3,912,081 | A | 10/1975 | Haines et al. | |
| 3,912,082 | A | 10/1975 | Gerner et al. | |
| 3,921,805 | A | 11/1975 | Compere | |
| 3,924,746 | A | 12/1975 | Haines | |
| 3,924,747 | A | 12/1975 | Gerner | |
| 3,941,248 | A | 3/1976 | Moser et al. | |
| 4,120,400 | A | 10/1978 | Kotyuk | |
| 4,125,190 | A | 11/1978 | Davie, Jr. et al. | |
| 4,192,422 | A | 3/1980 | Kotyuk | |
| 4,231,477 | A | 11/1980 | De Felice | |
| 4,485,915 | A | 12/1984 | Berghahn | |
| 5,046,618 | A | 9/1991 | Wood | |

(Continued)

FOREIGN PATENT DOCUMENTS

| | | |
|---|---|---|
| WO | WO 96/03329 | 2/1996 |

(Continued)

*Primary Examiner*—Jila M. Mohandesi
(74) *Attorney, Agent, or Firm*—Robert J. Smith

(57) ABSTRACT

A child resistant blister package includes a film having a surface wherein a plurality of cavities are formed therein containing at least one medicament; a cover sheet which overlies the cavities and is bonded to the film; and a wall structure raised above the surface of the film which extends throughout the film forming an interior region enclosing the plurality of cavities therein.

38 Claims, 8 Drawing Sheets

U.S. PATENT DOCUMENTS

| | | | | |
|---|---|---|---|---|
| 5,172,812 | A | 12/1992 | Wharton et al. | |
| 5,310,060 | A * | 5/1994 | Bitner et al. | 206/532 |
| 5,529,188 | A | 6/1996 | Coggswell | |
| 6,047,829 | A | 4/2000 | Johnstone et al. | |
| 6,375,956 | B1 | 4/2002 | Hermelin et al. | |
| 6,523,691 | B1 | 2/2003 | Raj et al. | |
| 2001/0017273 | A1 * | 8/2001 | Raj et al. | 206/531 |
| 2002/0185404 | A1 * | 12/2002 | Donegan | 206/531 |
| 2003/0064381 | A1 | 4/2003 | Feder et al. | |

FOREIGN PATENT DOCUMENTS

| | | |
|---|---|---|
| WO | WO 97/39963 | 10/1997 |
| WO | WO 00/24647 | 5/2000 |
| WO | WO 01/32532 | 5/2001 |

* cited by examiner

CHILD RESISTANT BLISTER PACKAGES UTILIZING WALLED STRUCTURES ENCLOSING MEDICAMENT THEREIN

CROSS-REFERENCE TO RELATED APPLICATIONS

This application is filed under 35 U.S.C. §371 as the United States National Phase Application of International Application No. PCT/US04/016124 filed May 20, 2004, which claims priority to U.S. Provisional Application No. 60/472,064 filed May 20, 2003.

FIELD AND BACKGROUND OF THE INVENTION

The invention generally relates to child resistant blister packages. The child-resistant ("CR") requirement for products packaged in blisters is typically dependent upon the toxicity level of any given product. Currently, the more toxic the drug, the more difficult the opening feature is made to gain access to the product in order to pass Consumer Product Safety Commission ("CPSC") protocol requirements. In cases where a single tablet or capsule is considered harmful to a 25 lbs. child, there are very few, if any, options available that are considered "user friendly". The existing options that pass official protocol testing require multiple steps that can be physically challenging and/or require an implement i.e.; scissors to open. Thus, there is a need in the art for a child-resistant blister package that addresses problems associated with the above-mentioned existing options.

SUMMARY OF THE INVENTION

This invention substantially minimizes or prevents children from gaining access in accordance with the above protocol limits while at the same time is capable of opening similarly to a non-CR push through blister design.

More particularly, the invention provides a child resistant blister package. The child resistant blister package comprises a film having a surface wherein a plurality of cavities are formed therein containing at least one medicament; a cover sheet which overlies the cavities and is attached to the film; and a wall structure raised above the surface of the film which extends throughout the film forming an interior region such that the plurality of cavities are enclosed within the interior region.

Most children gain access to blister packaged products by biting through the clear blister material. In accordance with the present invention, the presence of the wall structure substantially minimizes or eliminates the probability of a child from gaining access to a blister by penetrating the blister with his or her teeth.

DETAILED DESCRIPTION OF THE EMBODIMENTS

Figure 1:
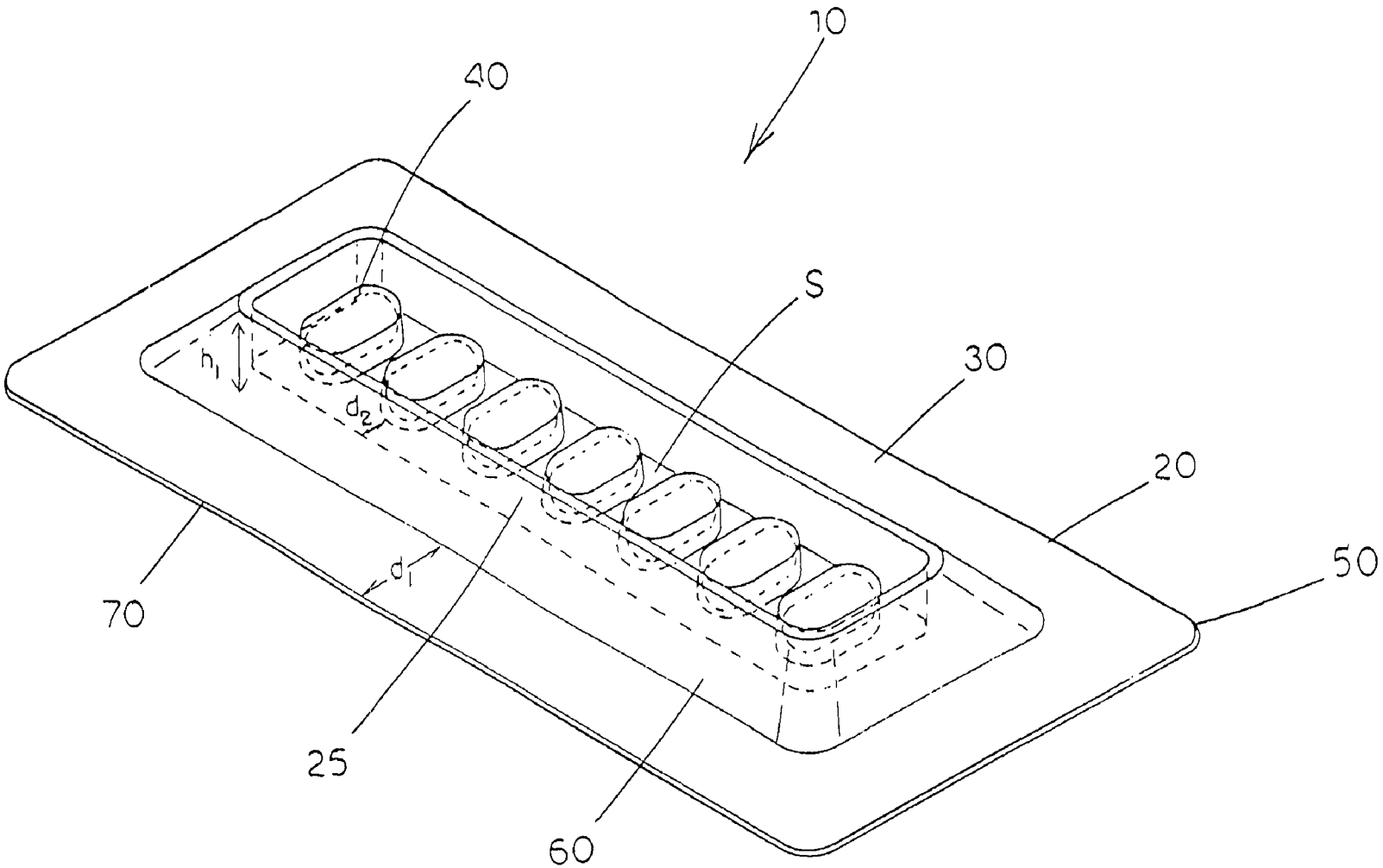
FIG. 1 is a perspective view of a blister package in accordance with the present invention.

The present invention will now be described in reference to the embodiments set forth herein, including, without limitation, those described in the drawings. It should be appreciated that these embodiments are for illustrative purposes only, and are not intended to limit the scope of the invention as defined by the claims.

All publications, patents, and patent applications cited herein, whether supra or infra, are hereby incorporated herein by reference in their entirety to the same extent as if each individual publication, patent, or patent application was specifically and individually indicated to be incorporated by reference.

It must be noted that, as used in the specification and appended claims, the singular forms "a", "an" and "the" include plural referents unless the content clearly dictates otherwise.

In one aspect, the invention provides a child resistant blister package. The child resistant blister package comprises a film having a surface wherein a plurality of cavities are formed therein containing at least one medicament; a cover sheet which overlies the cavities and is attached to the film; and a wall structure raised above the surface of the film which extends throughout the film forming an interior region such that the plurality of cavities are enclosed within the interior region.

Various materials may be used in forming the film of the present invention. Examples materials include various materials formed from polymers that may include, without limitation, polyvinyl chloride, polyvinylidene chloride, polypropylene, polyethylene, polychlorotrifluoroethylene, and combinations thereof. The blisters are formed by employing known techniques, such as application of vacuum.

The cover sheet may include various materials, non-limiting embodiments including cellulose, polymer, metal, as well as combinations thereof. In one embodiment, the cover sheet includes a metallic foil layer secured to the film and enclosing the opening of the blisters. The cover sheet is rupturable upon manual compression of a blister containing medicament by a patient which releases the medicament. If employed, a metallic foil preferably comprises aluminum. In one embodiment, a first layer, formed from any of the materials set forth herein, is preferably backed by a second layer, preferably containing paperboard, such that the cover sheet is preferably present as a laminate. The cover sheet may be attached to the film using a technique which is accepted in the art.

The blisters in the package of the invention may be present in numerous configurations. As an example, in one embodiment, the package may include at least one ordered arrangement (i.e., row or column) of blisters. In one embodiment, the package may include at least or two rows or columns of blisters. In one embodiment, the package may include four rows or columns of blisters.

Examples of embodiments of materials employed in blister packages and methods of making the same are set forth in U.S. Pat. Nos. 3,905,479; 3,912,082; 3,924,747; 3,835,995; 3,912,081; 3,924,746; 3,809,220; 3,809,221; 3,811,564; 3,872,970; 3,899,080; 3,921,805; and 3,941,248.

The term "medicament", as used herein, is meant to mean and include any substance (i.e., compound or composition of matter) which, when administered to an organism (human or animal) induces a desired pharmacologic and/or physiologic effect by local and/or systemic action. The term therefore encompasses substances traditionally regarded as actives, drugs and bioactive agents, as well as biopharmaceuticals (e.g., peptides, hormones, nucleic acids, gene constructs, etc.) typically employed to treat a number of conditions which is defined broadly to encompass diseases, disorders, infections, and the like. Exemplary medicaments include, without limitation, antibiotics, antivirals, $H_2$-receptor antagonists, $5HT_1$ agonists, $5HT_3$ antagonists, COX2-inhibitors, medicaments used in treating psychiatric conditions such as depression, anxiety, bipolar condition, tranquilizers, medicaments used in treating metabolic conditions, anticancer medicaments, medicaments used in treating neurological conditions such as epilepsy and Parkinsons Disease, medicaments used in treating cardiovascular conditions, non-steroidal anti-inflammatory medicaments, medicaments used in treating Central Nervous System conditions, and medicaments employed in treating hepatitis.

Antivirals are particularly preferred. Examples of medicaments that are effective for the treatment of viral and viral associated conditions are (1-alpha, 2-beta, 3-alpha)-9-[2,3-bis(hydroxymethyl)cyclobutyl]guanine [(−)BHCG, SQ-34514, lobucavir], 9-[(2R,3R,4S)-3,4-bis(hydroxymethyl)-2-oxetanosyl]adenine(oxetanocin-G), acyclic nucleosides, for example acyclovir, valaciclovir, famciclovir, ganciclovir, and penciclovir, acyclic nucleoside phosphonates, for example (S)-1-(3-hydroxy-2-phosphonyl-methoxypropyl)cytosine (HPMPC), [[[2-(6-amino-9H-purin-9-yl) ethoxy]methyl]phosphinylidene]bis(oxymethylene)-2,2-dimethylpropanoic acid (bis-POM PMEA, adefovir dipivoxil), [[(1R)-2-(6-amino-9H-purin-9-yl)-1-methylethoxy]methyl]phosphonic acid(tenofovir), and (R)-[[2-(6-Amino-9H-purin-9-yl)-1-methylethoxy]methyl]phosphonic acid bis-(isopropoxy carbonyloxymethyl)ester (bis-POC-PMPA), ribonucleotide reductase inhibitors, for example 2-acetylpyridine 5-[(2-chloroanilino)thiocarbonyl)thiocarbonohydrazone and hydroxyurea, nucleoside reverse transcriptase inhibitors, for example 3'-azido-3'-deoxythymidine (AZT, zidovudine), 2',3'-dideoxycytidine (ddC, zalcitabine), 2',3'-dideoxyadenosine, 2',3'-dideoxyinosine (ddI, didanosine), 2',3'-didehydrothymidine (d4T, stavudine), (−)-beta-D-2,6-diaminopurine dioxolane (DAPD), 3'-azido-2', 3'-dideoxythymidine-5'-H-phosphophonate (phosphonovir), 2'-deoxy-5-iodo-uridine(idoxuridine), (−)-cis-1-(2-hydroxymethyl)-1,3-oxathiolane 5-yl)-cytosine (lamivudine), cis-1-(2-(hydroxymethyl)-1,3-oxathiolan-5-yl)-5- fluorocytosine(FTC), 3'-deoxy-3'-fluorothymidine, 5-chloro-2',3'-dideoxy-3'-fluorouridine, (−)-cis-4-[2-amino-6-(cyclopropylamino)-9 H-purin-9-yl]-2-cyclopentene-1-methanol(abacavir), 9-[4-hydroxy-2-(hydroxymethyl)but-1-yl]-guanine(H2G), ABT-606 (2HM-H2G) and ribavirin, protease inhibitors, for example indinavir, ritonavir, nelfinavir, amprenavir, saquinavir, (R)-N-tert-butyl-3-[(2S,3S)-2-hydroxy-3-N-[(R)-2-N-(isoquinolin-5-yloxyacetyl)amino-3-methylthiopropanoyl]amino-4-phenylbutanoyl]-5,5-dimethyl-1,3-thiazolidine-4-carboxamide (KNI-272), 4R-(4alpha,5alpha, 6beta)]-1,3-bis[(3-aminophenyl)methyl]hexahydro-5,6-dihydroxy-4,7-bis(phenylmethyl)-2H-1,3-diazepin-2-one dimethanesulfonate(mozenavir), 3-[1-[3-[2-(5-trifluoromethylpyridinyl)-sulfonylamino]phenyl]propyl]-4-hydroxy-6alpha-phenethyl-6beta-propyl-5,6-dihydro-2-pyranone (tipranavir), N'-[2(S)-Hydroxy-3(S)-[N-(methoxycarbonyl)-I-tert-leucylamino]-4-phenylbutyl-N$^{alpha}$-(methoxycarbonyl)-N'-[4-(2-pyridyl)benzyl]-L-tert-leucylhydrazide(BMS-232632), 3-(2(S)-Hydroxy-3(S)-(3-hydroxy-2-methylbenzamido)-4-phenylbutanoyl)-5,5-dimethyl-N-(2-methylbenzyl)thiazolidine-4(R)-carboxamide(AG-1776), N-(2(R)-hydroxy-1(S)-indanyl)-2(R)-phenyl-methyl-4(S)-hydroxy-5-(1-(1-(4-benzo[b] furanylmethyl)-2(S)-N'-(tert-butylcarboxamido) piperazinyl)pentanamide (MK-944A), and (3S)-tetrahydrofuran-3-yl (1S,2R)-[[(4-aminophenyl)sulphonyl)] (isobutyl)amino]-1-benzyl-2-(phosphonooxy) propylcarbamate monocalcium salt(fosamprenavir), interferons such as α-interferon, renal excretion inhibitors such as probenecid, nucleoside transport inhibitors such as dipyridamole; pentoxifylline, N-acetylcysteine (NAC), Procysteine, α-trichosanthin, phosphonoformic acid, as well as immunomodulators such as interleukin II or thymosin, granulocyte macrophage colony stimulating factors, erythropoetin, soluble $CD_4$ and genetically engineered derivatives thereof, non-nucleoside reverse transcriptase inhibitors (NNRTIs), for example nevirapine (BI-RG-587), alpha-((2-acetyl-5-methylphenyl)amino)-2,6-dichloro-benzeneacetamide (loviride), 1-[3-(isopropylamino)-2-pyridyl]4-[5-(methanesulfonamido)-1H-indol-2-ylcarbonyl]piperazine monomethanesulfonate (delavirdine), (10R, 11S, 12S)-12-Hydroxy-6,6,10,11-tetramethyl-4-propyl-11,12-dihydro-2H, 6H, 10H-benzo(1, 2-b:3, 4-b':5, 6-b")tripyran-2-one ((+) calanolide A), (4S)-6-Chloro-4-[1E)-cyclopropylethenyl )-3,4-dihydro-4-(trifluoromethyl)-2(1H)-quinazolinone (DPC-083), (S)-6-chloro-4-(cyclopropylethynyl)-1,4-dihydro4-(trifluoromethyl)-2H-3,1-benzoxazin-2-one(efavirenz, DMP 266), 1-(ethoxymethyl)-5-(1-methylethyl)-6-(phenylmethyl)-2,4(1H,3H)-pyrimidinedione (MKC-442), and 5-(3,5-dichlorophenyl)thio-4-isopropyl-1-(4-pyridyl)methyl-1H-imidazol-2-ylmethyl carbamate(capravirine), glycoprotein 120 antagonists, for example PRO-2000, PRO-542 and 1,4-bis[3-[(2,4-dichlorophenyl)carbonylamino]-2-oxo-5,8-disodiumsulfanyl]naphthalyl-2,5-dimethoxyphenyl-1,4-dihydrazone (FP-21399), cytokine antagonists, for example reticulose (Product-R), 1,1'-azobis-formamide (ADA), 1,11-(1,4-phenylenebis(methylene))bis-1,4,8,11-tetraazacyclotetradecane octahydrochloride (AMD-3100), integrase inhibitors, for example, S-1360, and fusion inhibitors.

The term medicament also encompasses pharmaceutically acceptable salts, esters, solvates, and/or hydrates of the pharmaceutically active substances referred to hereinabove. Various combinations of any of the above medicaments may also be employed.

In accordance with the present invention, the medicament is typically employed in an oral pharmaceutical formulation. An oral pharmaceutical formulation typically refers to the combination of at least one medicament and one or more added components or elements, such as an "excipient" or "carrier." As will be appreciated by one having ordinary skill in the art, the terms "excipient" and "carrier" generally refer to substantially inert materials that are nontoxic and do not interact with other components of the composition in a deleterious manner. Examples of normally employed "excipients," include pharmaceutical grades of carbohydrates, including monosaccharides, disaccharides, cyclodextrins and polysaccharides (e.g., dextrose, sucrose, lactose, raffinose, mannitol, sorbitol, inositol, dextrins and maltodextrins); starch; cellulose; salts (e.g., sodium or calcium phosphates, calcium sulfate, magnesium sulfate); citric acid; tartaric acid; glycine; leucine; high molecular weight polyethylene glyols (PEG); pluronics; surfactants; lubricants; stearates and their salts or esters (e.g., magnesium stearate); amino acids; fatty acids; and combinations thereof.

The oral pharmaceutical formulation may be utilized in a variety of unit dosage forms including, without limitation, a tablet, a pill, a capsule, a lozenge, and combinations thereof. The unit dosage forms may encompass hospital unit dosage forms, as well as others.

In one embodiment, a combination of lamivudine, zidovudine, and nevirapine is employed in the blister package. More specifically, it is preferred to employ the above medicaments in a combination regimen wherein a first pharmaceutical formulation includes lamivudine and zidovudine and a second pharmaceutical formulation include nevirapine. In such an embodiment, it is preferred that the first pharmaceutical formulation and the second pharmaceutical formulation be present in unit dosage forms in discrete blisters.

The invention will now be described with respect to the drawings. It should be appreciated that the drawings are merely set forth to illustrate the invention and do not serve to limit the scope of the invention as defined by the claims.

FIGS. 1–7 illustrate blister packages 10 in accordance with the present invention. As shown, the package 10 includes a film 20 having a surface 30 and plurality of cavities or blisters 40 formed therein. The cavities 40 are configured to house at least one medicament in unit dosage form. A cover sheet 50 is present on the bottom of film 20 and is bonded thereto. Film 20 preferably has a thickness ranging from about 0.7 mm to about 2.0 mm. As shown, the cover sheet 50 overlies cavities 40. As stated herein, the cover sheet 50 may include a plurality of layers as described herein and can be present in the form of a laminate. The cover sheet 50 preferably has a thickness ranging from about 0.025 mm to about 0.076 mm.

As shown, a wall structure 60 is present which is above the film surface 30. In particular, the wall structure 60 is coextensive with the periphery or outer edge of the film 20 (preferably extending parallel or substantially parallel to the film periphery) forming an interior region 25 within the film 20 so as to enclose the cavities 40 therein. As shown, the wall structure 60 rises from the film surface having a first face extending from the film surface proximal to the outer film edge 70 and a second face extending from the film surface distal to the outer film edge 70. A top portion may additionally be present to adjoin the two faces. The wall structure 60 is configured so as to leave a certain surface area (denoted as s) of film between it and the cavities 40. The wall structure 60 may be unitary with the film 20 or may be employed as a separate structure which is positioned on the film 20. Preferably, the wall structure 60 can be formed from a number of materials such as, without limitation, polyvinyl chloride, polyvinylidene chloride, polypropylene, polyethylene, polychlorotrifluoroethylene, as well as combinations thereof. The wall structure 60 may be transparent or opaque. Advantageously, the wall structure 60 is dimensioned and positioned such that the probability of a child accessing medicament in a blister is substantially reduced or eliminated. Preferably, the distance from the outer edge 70 of the blister pack 10 to the edge of wall structure 60 proximal to outer edge 70 (denoted as di) ranges from about 3.175 mm to about 25.4 mm. Preferably, the top height of the wall structure 60 (denoted as $h_1$) ranges from about 3.175 mm to about 12.7 mm. Preferably, the distance from a row or column of cavities 40 to the edge of the wall structure 60 proximal to the row or column of cavities (denoted as $d_2$) ranges from about 3.175 mm to about 12.7 mm.

Figure 3:
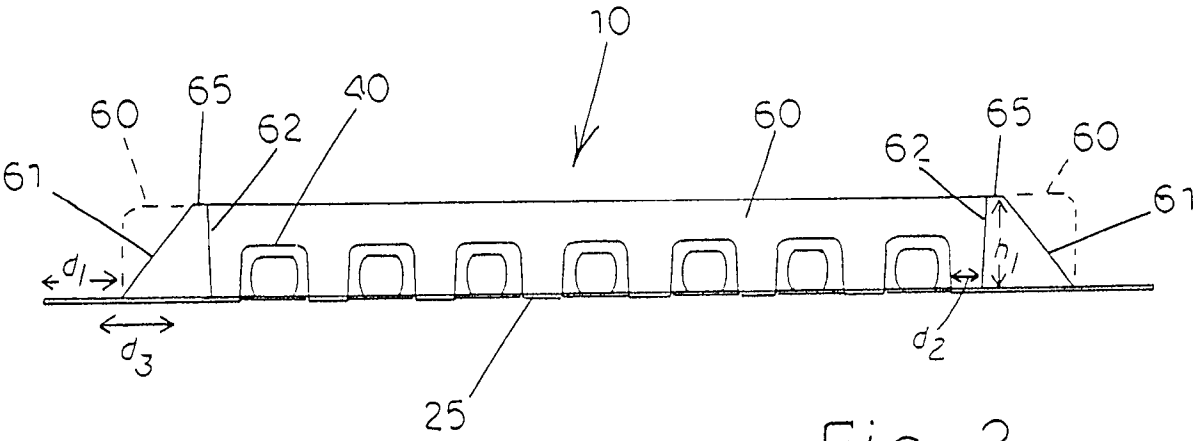
FIG. 3 is a side cross-sectional view of a blister package in accordance with the present invention.
Figure 4:
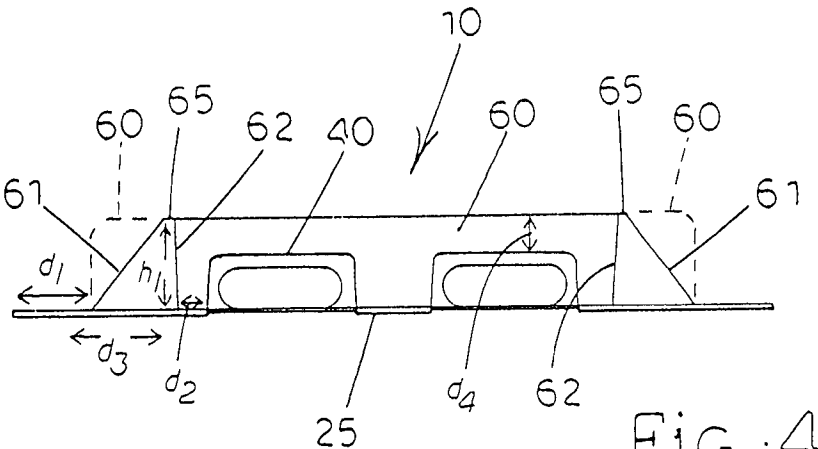
FIG. 4 is a side cross-sectional view of a blister package in accordance with the present invention.

A cross-sectional side view of the blister pack 10 is illustrated in FIGS. 3–4. In particular, FIG. 3 illustrates an end view of blister pack 10 and FIG. 4 illustrates a view of blister pack 10 along its length. Referring to FIG. 4, wall structure 60 may be solid or have void spaces present therein, and includes a face 61 proximal to outer edge 70 and a face 62 distal to outer edge 70. Faces 61 and 62 are connected via top portion 65 in this embodiment. As seen in these embodiments, the wall structure 60 has a largely triangular cross-section. Nonetheless, it should be appreciated by one skilled in the art that the wall structure may encompass other geometries without departing from the scope of the invention. For example, the cross-section of the wall structure may be rectangular as denoted by dashed lines in FIGS. 3–4. Moreover, it should be appreciated that the structure may have rounded corners as well as those which are present as illustrated in FIGS. 3–4 denoted as 65. Notwithstanding the geometry of the wall structure 60 illustrated in FIGS. 3–4, the wall structure 60 preferably has a width (denoted as $d_3$) ranging from about 3.175 mm to about 12.7 mm. Preferably, the distance from the top of a blister to the top of the wall structure (denoted as $d_4$) ranges from about 0 mm to about 6.35 mm.

Figure 2:
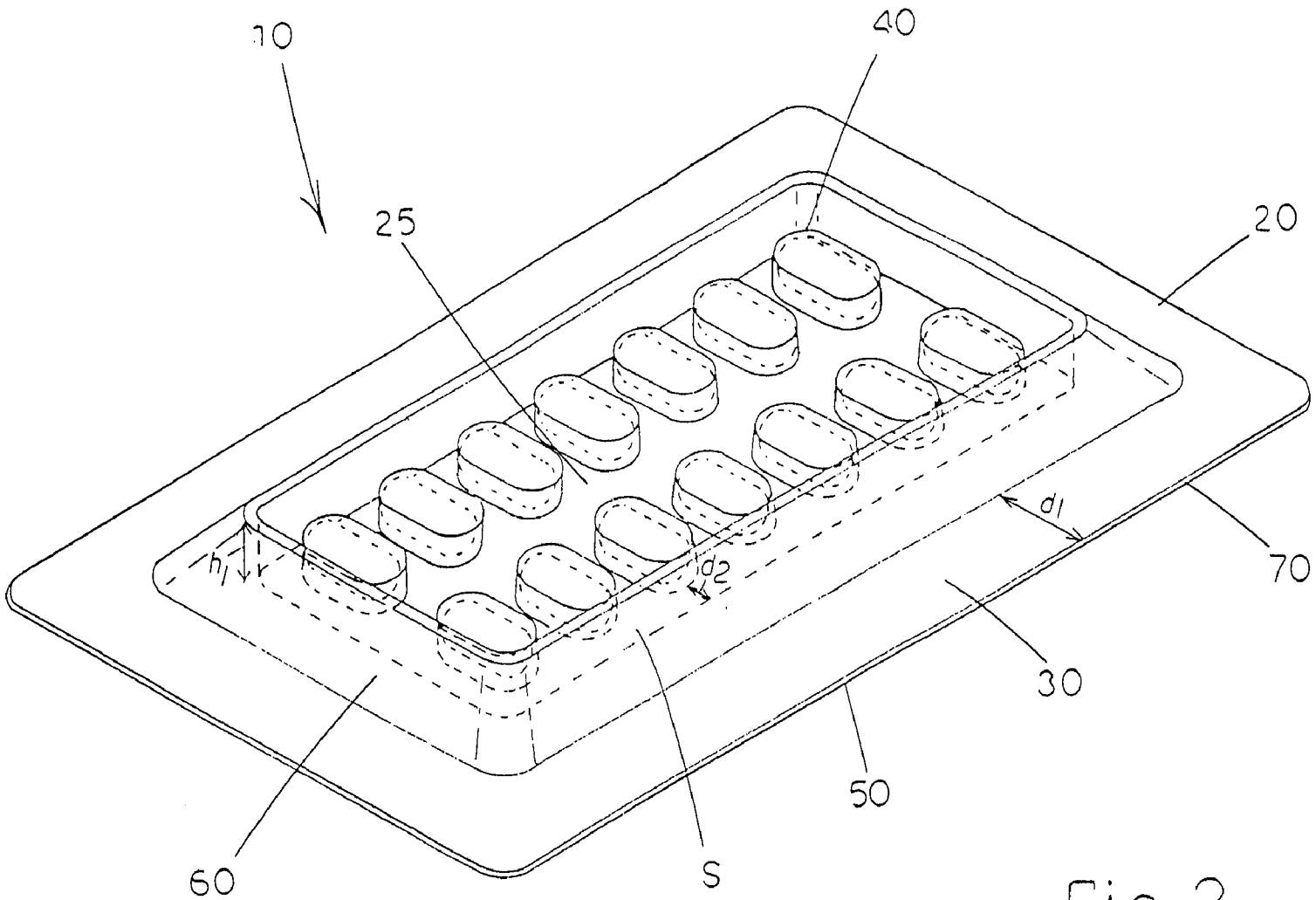
FIG. 2 is a perspective view of a blister package in accordance with the present invention.
Figure 5:
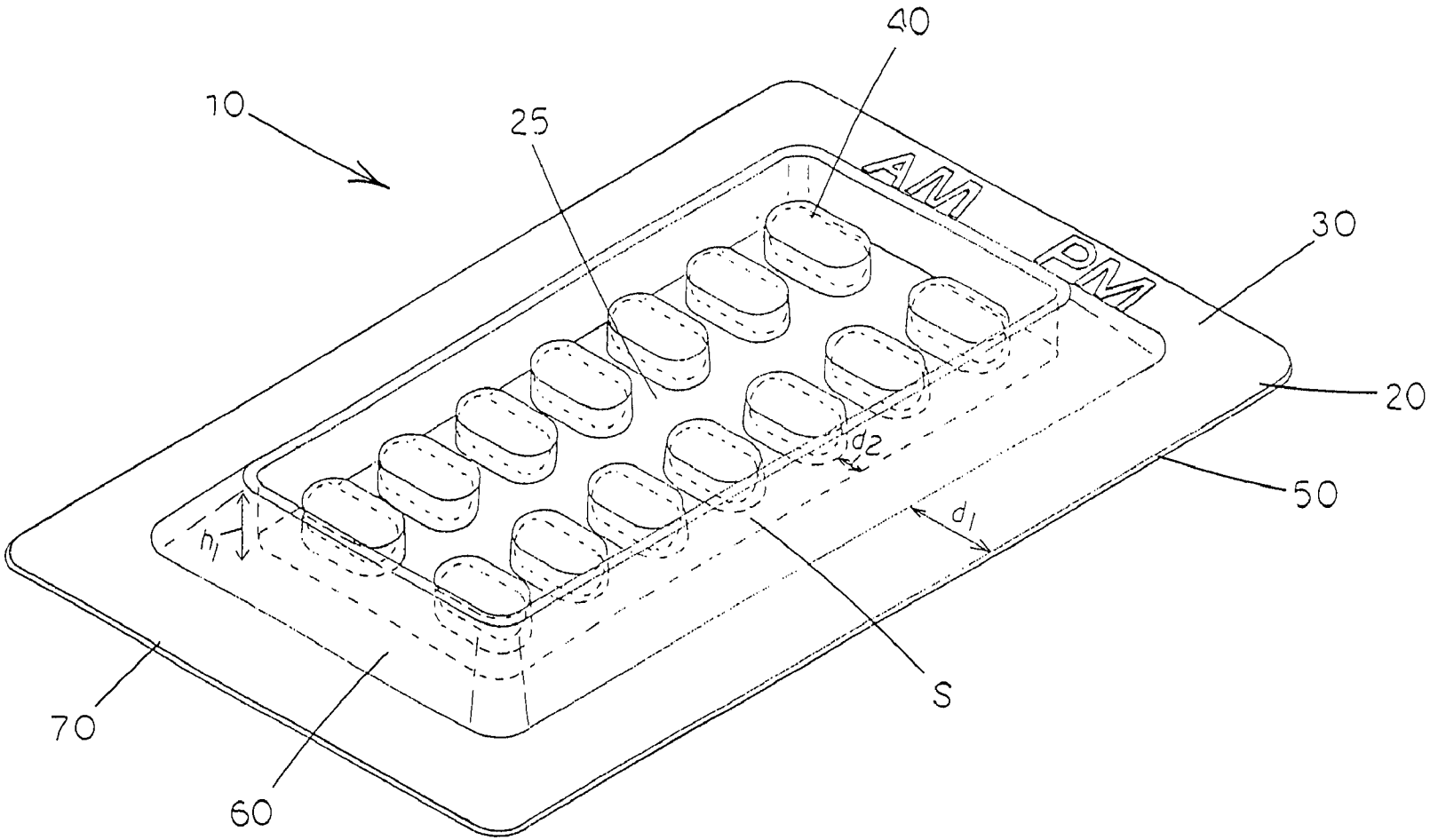
FIG. 5 is a perspective view of a blister package in accordance with the present invention.
Figure 6:
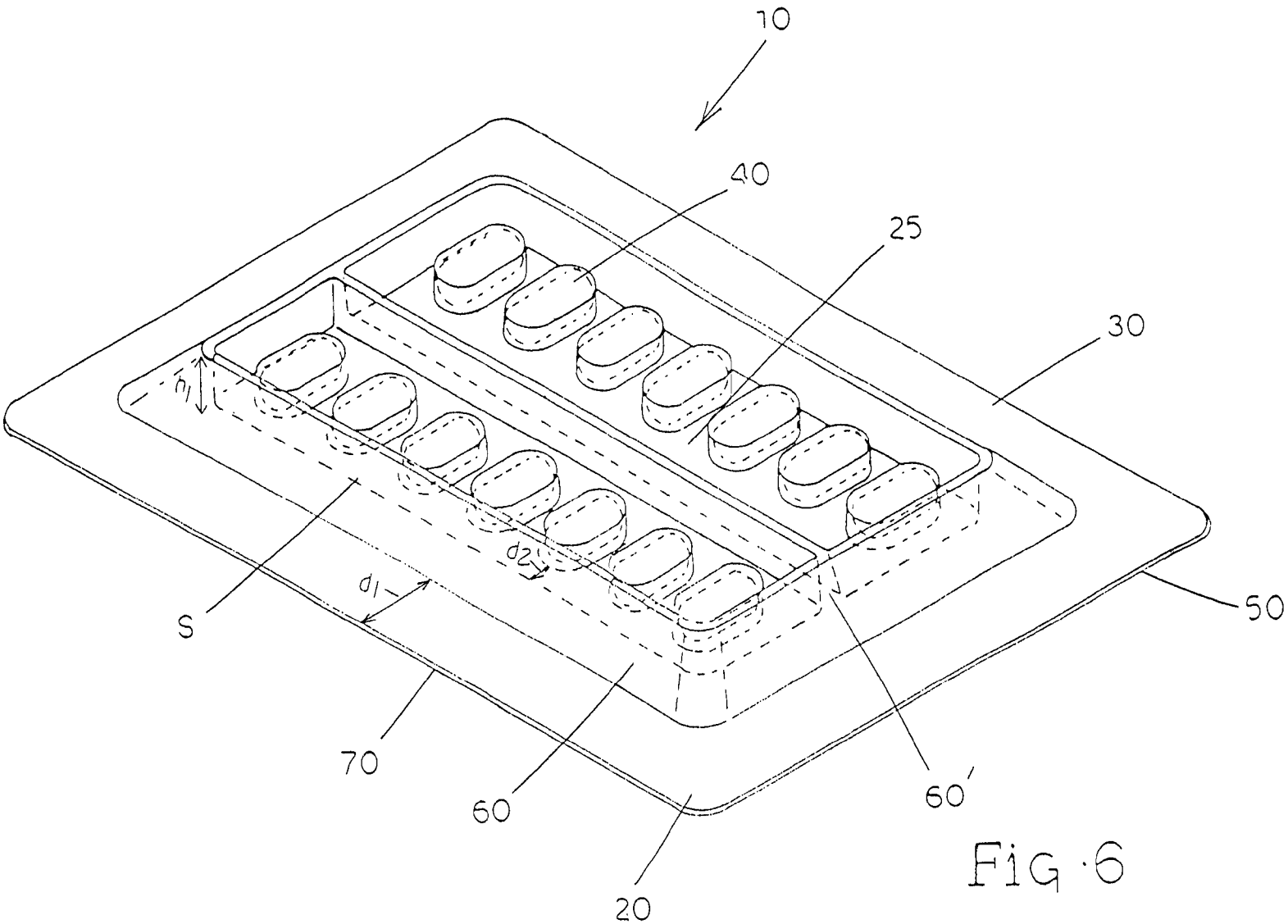
FIG. 6 is a perspective view of a blister package in accordance with the present invention.

As shown in FIGS. 2, 5 and 6, the blister package 10 may encompass multiple columns. Such packages may be fabricated according to techniques known in the art. As an example, the structure of the blister columns may be separately assembled and thereafter joined together by using, for example, ultrasonic welding.

The blister package 10 according to the present invention may be employed in a variety of capacities. As an example, the blister package 10 can be used as a sample package, i.e., a package which may include, in various non-limiting embodiments, a one-day or two week supply of medicament. Additionally, the blister package 10 may be employed as a compliance package, i.e., a package used for assisting the patient in conforming with his or her prescribed dosage regimen. Embodiments of compliance packages are set forth in FIGS. 5 and 7. As illustrated, in this embodiment, labels A.M. and P.M. are assigned to the top of each column designating the time of day for taking the medicament corresponding to each row. Although not explicitly indicated, each row in these embodiments corresponds to a single day.

Figure 7:
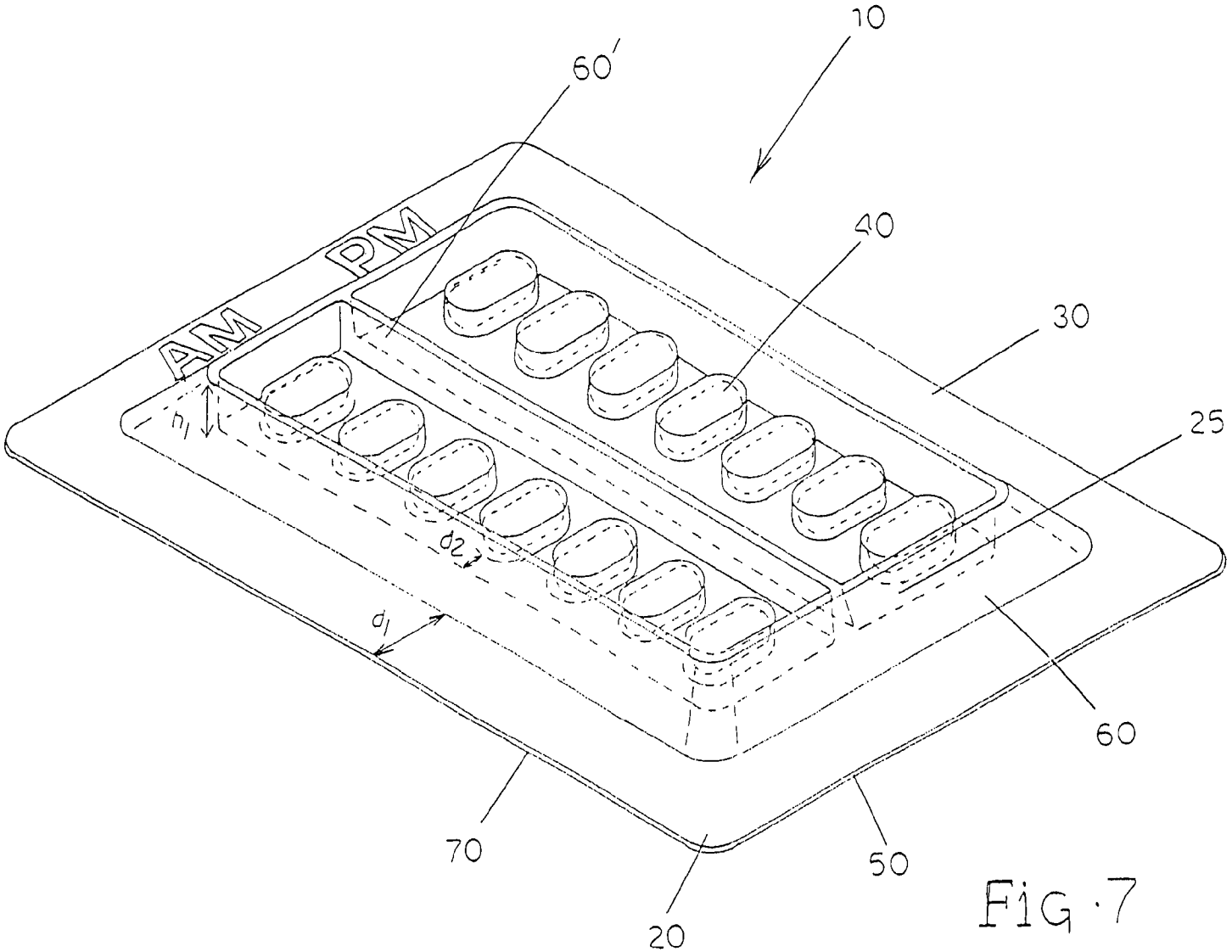
FIG. 7 is a perspective view of a blister package in accordance with the present invention.

In non-limiting examples as shown in FIGS. 6–7, a wall structure 60' may be present between two blister columns so as to separate the columns and provide further protection against a child potentially gaining access to medicament.

Figure 8:
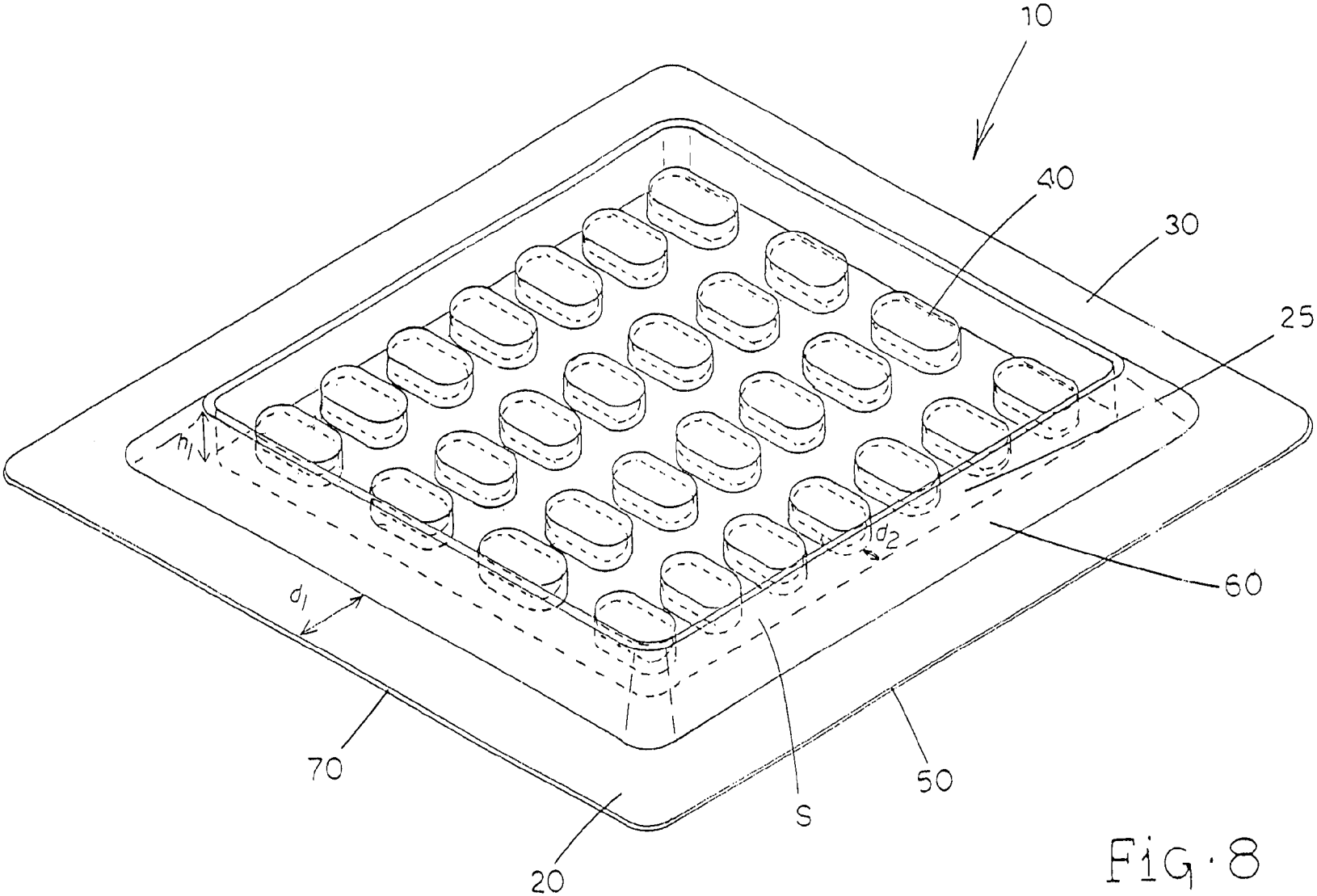
FIG. 8 is a perspective view of a blister package in accordance with the present invention.

FIG. 8 depicts a blister package 10 having four columns and seven rows. Such a blister package 10 can be used in a variety of manners. As an example, in one non-limiting embodiment, the two columns on the far left may contain two distinct pharmaceutical formulations present in discrete blisters, i.e., one column contains a first pharmaceutical formulation and the second column contains a second pharmaceutical formulation. Likewise, the third column from left may contain the first pharmaceutical formulation and the fourth column from left contains the second pharmaceutical formulation. In such an embodiment, the first and second columns represent the A.M. dosages and the third and fourth columns represent the P.M. dosages. It should be appreciated that a number of deviations from this embodiment can be made. For example, all four columns may all contain distinct formulations or the same or similar formulations.

Figure 9:
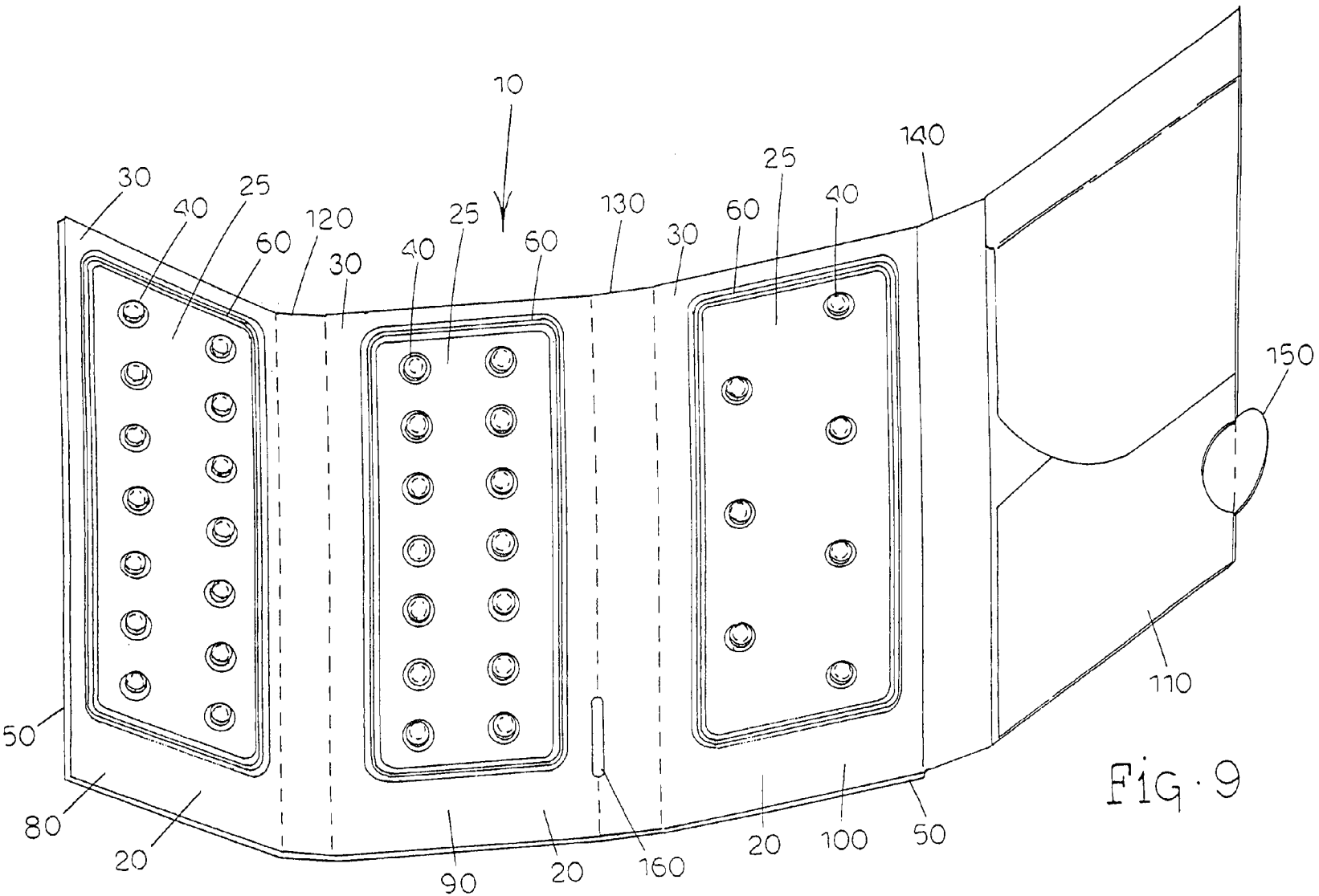
FIG. 9 is a perspective view of a blister package in accordance with the present invention.

FIG. 9 illustrates an embodiment of a blister package 10 in accordance with the present invention. As shown, blister package 10 has a plurality of columns present on various flats (denoted as 80, 90, 100, and 110). The flats are joined by hinges 120, 130, and 140 such that the flats may fold into an convenient overlapped structure. Tongue 150 is configured to fit in slot 160 to secure package 10.

Notwithstanding the embodiments set forth in the figures herein, it should be appreciated that any number of rows and/or columns may be employed in the blister package of the present invention in addition to these embodiments.

The present invention has been described with respect to the embodiments set forth herein. Nonetheless, it should be noted that such embodiments are merely set forth to illustrate the invention, and do not limit its scope as defined by the claims set forth herein.

What is claimed is:

1. A child resistant blister package comprising:

a film having an outer edge and a surface wherein a plurality of cavities are formed therein containing at least one medicament;

a cover sheet which overlies said cavities and is bonded to said film; and a wall structure present above the film surface and having a height measured from the film surface to the top of the wall structure and an edge located proximal to the outer edge of the film, wherein said wall structure is coextensive with the outer edge of the film such that an interior region within the film is present to envelop said plurality of cavities therein;

wherein the distance from the outer edge of the film to the outer edge of the wall structure proximal to the outer edge of the film ranges from about 3.175 mm to about 25.4 mm and wherein the height of the wall structure ranges from about 3.175 mm to about 12.7 mm.

2. The blister package according to claim I, wherein said plurality of cavities are present in at least one column.

3. The blister package according to claim 1, wherein said plurality of cavities are present in two columns.

4. The blister package according to claim 1, wherein said plurality of cavities are present in four columns.

5. The blister package according to claim 1, wherein said cover sheet comprises a material selected from the group consisting of cellulose, polymer, metal, and combinations thereof.

6. The blister package according to claim 5, the cover sheet is present in the form of a metallic foil layer and wherein the metallic foil layer comprises aluminum.

7. The blister package according to claim 6, wherein the cover sheet further comprises a second layer attached to the bottom of said metallic foil layer.

8. The blister package according to claim 7, wherein the second layer comprises paperboard, and wherein the cover sheet is present as a laminate.

9. The blister package according to claim 1, wherein said film comprises a material selected from the group consisting of polyvinyl chloride, polyvinylidene chloride, polypropylene, polyethylene, polychlorotrifluoroethylene, and combinations thereof.

10. The blister package according to claim 1, wherein said wall structure comprises a material selected from the group consisting of polyvinyl chloride, polyvinylidene chloride, polypropylene, polyethylene, polychlorotrifluoroethylene, and combinations thereof.

11. The blister package according to claim 1, wherein the at least one medicament is selected from the group consisting of antibiotics, antivirals, $H_2$-receptor antagonists, $5HT_1$ agonists, $5HT_3$ antagonists, COX2-inhibitors, medicaments used in treating psychiatric conditions, medicaments used in treating metabolic conditions, anticancer medicaments, medicaments used in treating neurological conditions, medicaments used in treating cardiovascular conditions, non-steroidal anti-inflamatories medicaments, medicaments used in treating Central Nervous System conditions, medicaments employed in treating Hepatitis B and C, and combinations thereof.

12. The blister package according to claim 1, wherein the at least one medicament comprises an antiviral.

13. The blister package according to claim 12, wherein the antiviral is a nucleoside reverse transcriptase inhibitor.

14. The blister package according to claim 1, wherein the at least one medicament comprises lamivudine, zidovudine, viramune, and combinations thereof.

15. The blister package according to claim 1, wherein a first pharmaceutical formulation comprises lamivudine and zidovudine and a second pharmaceutical formulation comprises viramune and wherein the first pharmaceutical formulation and the second pharmaceutical formulation are present in discrete blisters.

16. The blister package according to claim 15, wherein the blisters are present in at least two columns, and wherein the first column contains blisters comprising the first pharmaceutical formulation and the second column contains blisters comprising the second pharmaceutical formulation.

17. The blister package according to claim 1, wherein the package is present as a compliance pack.

18. The blister package according to claim 1, wherein the package is present as a sample pack.

19. The blister package according to claim 1, wherein the medicament is present in an oral pharmaceutical formulation.

20. The blister package according to claim 19, wherein the oral pharmaceutical formulation is present in a unit dosage form selected from the group consisting of a tablet, a pill, a capsule, a lozenge, and combinations thereof.

21. The blister package according to claim 1, wherein said wall structure is unitary with said film.

22. A child resistant blister package comprising:

a film having and outer edge and a surface wherein a plurality of cavities are formed therein containing at least one medicament, said plurality of cavities being present in at least one column;

a cover sheet which overlies said cavities and is bonded to said film, said cover sheet including at least one layer comprising a metallic foil; and a wall structure present above the film surface and having a height measured from the film surface to the top of the wail structure and an edge located proximal to the outer edge of the film wherein said wall structure is coextensive with the outer edge of the film such that an interior region within the film is present to envelop said plurality of cavities therein;

wherein the distance from the outer edge of the film to the outer edge the wall structure proximal to the outer edge of the film ranges from about 3.175 mm to about 25.4 mm and wherein the height of the wall structure ranges from about 3.175 mm to about 12.7 mm.

23. The blister package according to claim 22, wherein said plurality of cavities are present in two columns.

24. The blister package according to claim 22, wherein said plurality of cavities are present in four columns.

25. The blister package according to claim 22,wherein said cover sheet is present as a laminate.

26. The blister package according to claim 22, wherein said film comprises a material selected from the group consisting of polyvinyl chloride, polyvinylidene chloride, polypropylene, polyethylene, polychlorotrifluoroethylene, and combinations thereof.

27. The blister package according to claim 22, wherein said wall structure comprises a material selected from the group consisting of polyvinyl chloride, polyvinylidene chloride, polypropylene, polyethylene, polychlorotrifluoroethylene, and combinations thereof.

28. The blister package according to claim 22, wherein the at least one medicament is selected from the group consisting of antibiotics, antivirals, $H_2$-receptor antagonists, $5HT_1$ agonists, $5HT_3$ antagonists, COX2-inhibitors, medicaments used in treating psychiatric conditions, medicaments used in treating metabolic conditions, anticancer medicaments, medicaments used in treating neurological conditions, medicaments used in treating cardiovascular conditions, non-steroidal anti-inflamatories medicaments, medicaments used in treating Central Nervous System conditions, medicaments employed in treating Hepatitis B and C, and combinations thereof.

29. The blister package according to claim 22, wherein the at least one medicament comprises an antiviral.

30. The blister package according to claim 28, wherein the antiviral is a nucleoside reverse transcriptase inhibitor.

31. The blister package according to claim 22, wherein the at least one medicament comprises lamivudine, zidovudine, viramune, and combinations thereof.

32. The blister package according to claim 22, wherein a first pharmaceutical formulation comprises lamivudine and zidovudine and a second pharmaceutical formulation comprises viramune and wherein the first pharmaceutical formulation and the second pharmaceutical formulation are present in discrete blisters.

33. The blister package according to claim 32, wherein the blisters are present in at least two columns, and wherein the first column contains blisters comprising the first pharmaceutical formulation and the second column contains blisters comprising the second pharmaceutical formulation.

34. The blister package according to claim 22, wherein the package is present as a compliance pack.

35. The blister package according to claim 22, wherein the package is present as a sample pack.

36. The blister package according to claim 22, wherein the medicament is present in an oral pharmaceutical formulation.

37. The blister package according to claim 36, wherein the oral pharmaceutical formulation is present in a unit dosage form selected from the group consisting of a tablet, a pill, a capsule, a lozenge, and combinations thereof.

38. The blister package according to claim 22, wherein said wall structure is unitary with said film.

* * * * *

UNITED STATES PATENT AND TRADEMARK OFFICE

CERTIFICATE OF CORRECTION

PATENT NO. : 7,000,769 B2
APPLICATION NO. : 10/506879
DATED : February 21, 2006
INVENTOR(S) : Fred Mieras Killinger It is certified that error appears in the above-identified patent and that said Letters Patent is hereby corrected as shown below:

In column 9, line 25: “28” should be --29--

Signed and Sealed this

Twenty-fourth Day of June, 2008

JON W. DUDAS
*Director of the United States Patent and Trademark Office*